US005625606A

United States Patent [19]

Openiano

[11] Patent Number: 5,625,606

[45] Date of Patent: Apr. 29, 1997

[54] WRISTWATCH AND STRAP ENCLOSING A REMOVABLE PEN AND/OR PROBE, AND ALARMING THE REMOVAL OF SAME AFTER A PRESET INTERVAL

[76] Inventor: Renato M. Openiano, 934 Fuchsia La., San Diego, Calif. 92154

[21] Appl. No.: 403,297

[22] Filed: Mar. 14, 1995

[51] Int. Cl.[6] ..... G04B 37/00

[52] U.S. Cl. ..... 368/10; 368/282

[58] Field of Search ..... 368/281, 282, 368/10

[56] References Cited

U.S. PATENT DOCUMENTS

| | | | |
|---|---|---|---|
| 1,653,535 | 12/1927 | Bonhajo | 368/232 |
| 4,086,756 | 5/1978 | Drake | 368/10 |
| 5,398,218 | 3/1995 | Munnier et al. | 368/282 |
| 5,416,953 | 5/1995 | Hui | 368/282 |

FOREIGN PATENT DOCUMENTS

| | | | |
|---|---|---|---|
| 1205272 | 2/1960 | France | 368/282 |

*Primary Examiner*—Bernard Roskoski
*Attorney, Agent, or Firm*—William C. Fuess

[57] ABSTRACT

An enhanced case, strap or bracelet worn upon the wrist contains in separate cavities (i) a watch, calculator, telephone, radio or like device that, among other functions, keeps time, plus (ii) a writing, probing and/or pointing instrument. The case preferably houses a watch in its first cavity. Both (i) a double-ended instrument having a pen suitable for writing on one end, and a probe suitable for activating push button switches on the other end, and (ii) an electrical switch, are preferably housed in a second cavity having the shape of an elongate bore. Extraction or insertion of the instrument from the bore is sensed by the switch, and is electrically communicated to the watch to initiate a countdown timer. The interval of the countdown timer is preferably variably preset. A wearer/user of the enhanced case will, after the expiration of a preset time interval from any withdrawal of the instrument, be alerted by an alarm to return the instrument to its cavity within the housing, thereby aiding in preventing loss of the instrument.

9 Claims, 2 Drawing Sheets

WRISTWATCH AND STRAP ENCLOSING A REMOVABLE PEN AND/OR PROBE, AND ALARMING THE REMOVAL OF SAME AFTER A PRESET INTERVAL

BACKGROUND OF THE INVENTION

1. Field of the Invention

The present invention generally concerns (i) watches and watch cases, (ii) cases for all manner of devices, including watches, that are worn upon the wrist, and (iii) cases for writing instruments worn upon the wrist.

The present invention particularly concerns enhanced "watch" cases, straps, bracelets and like structures that, in addition to housing the works of watches and/or other instruments, also serve to provide a case for any of writing, pointing and/or probing instruments. The present invention also particularly concerns watch works and other works housed within enhanced cases that are (i) mechanically and (ii) electrically interactive with writing, probing and/or pointing instruments as are also housed in the enhanced cases.

2. Description of the Prior Art

Personal timepieces, or watches, have long been located at the wrist, ergo a "wristwatch". Circa 1995, a great many other functions useful to mobile person have also come to be embodied in various complex, generally electronic, devices that are also worn upon the wrist. Many of these new devices also perform, sometimes as a relatively minor feature, the timekeeping function of a standard wristwatch.

For example, wristwatches have been combined with calculators as calculator watches for some years.

More recently, wristwatches have been combined with digital electronic appointment books, or personal information managers. In one system a combination wristwatch and electronic calendar pad is preset to an upcoming appointment schedule of the user/wearer at and by a digital computer. The presetting normally transpires via a light communication link from the monitor of a personal computer, running appropriate software, to the combination wristwatch and electronic calendar pad. The combination wristwatch and electronic calendar pad, preset with an appointment schedule, is thereafter worn on the wrist of the user/wearer to both notify and alert him or her to scheduled occurrences.

Even the proverbial "Dick Tracy" wrist radio has most recently been brought to a new, and higher, degree of practical realization. A wrist-worn cellular telephone has recently been introduced. This cellular telephone will, as a quite modest incidental and additional function, also tell the time of day.

The present invention will be seen to concern aspects of integrating wrist-worn watches and electronic devices with non-electronic, non-time-keeping, mechanical writing, probing and/or pointing instruments. As such, the present invention deals with technology that is relatively simpler and less complex than any the technology by which a timekeeping function of a watch might be added to, or integrated with, with some complex electronic device. In particular, the present invention will be seen to deal with a case that serves to integrally house a pen, pencil, scribe or a like writing and pointing instrument in physical and in functional conjunction with a wristwatch, or with another (typically electronic) device that incorporates (howsoever remotely) the timekeeping function of a wristwatch. The case containing both the instrument and the device is located at and on the wrist.

The prior art concerning writing, probing and/or pointing instruments and their cases is thus also of relevance to the present invention. Despite the above-noted advances in digital aids to timekeeping, communication and calculation, an old-fashioned pen or pencil is frequently required in modern life circa 1995. The convenient retention of such a pen or pencil—which is normally light and compact—at and on the wrist is as old, and as simple, as the common expedient of temporarily holding such a pen or pencil on the wrist between periods of use by action of a rubber band. Sheaths that mount to the wrist and that house pens and pencils are also known. These sheaths are particularly useful in some sports, such a soccer, where an official must annotate a paper form while continuing in motion to monitor play.

Meanwhile, the recent incorporation or combination of certain expanded functionality—such as a calculator or a digital calendar or a cellular phone/wrist radio—with the timekeeping function of a digital wristwatch has frequently entailed the use of push button switches. The push button switches permit the wearer/operator of the device to enter data into, and/or to control, the device. A calculator or telephone keypad is often implemented, and commonly comprises a minimum of ten push button switches. If these switches are to be conveniently and effectively operated directly by the tips of normal human fingers, they must be of a certain minimum size and separation. Ergometric construction of a keypad for a wrist-mounted device normally requires either that (i) the keypad, and the wrist device upon which it is used, should be ungainly, uncomfortably and/or unfashionably large, or else (ii) the keys should be so small so as to be all but impossible to operate with the fingers.

One solution to the dilemma of matching multitudinous small push button switches to relatively larger human fingertips has been to have a wearer/user of a switch-activated wrist-mounted device activate the miniature push button switches of such a device by use of the tip of a pencil or pen, or with a small stick, or probe. A suitable probe is commonly supplied with the device. If a pencil or pen is conveniently used to push and to activate selected push button switches, then it has a tendency to mark the tops of the push button switches, undesirably defacing the switches and the device. Conversely, a non-marking probe or other activation device that does not mark the push button switches may be potentially misplaced or lost, and has of no great use for any other function—particularly including writing.

Accordingly, the various previous housings worn at or on the wrist for containing (i) writing instruments (e.g., pens or pencils), (ii) miniature probes and/or pointers, and/or (iii) wristwatches and all manner of devices broadly descended from and related to wristwatches, are somewhat poorly integrated. Some attempt would desirably be made to develop a higher degree of integration, and user convenience, between these various functions, instruments and devices. This improved integration, and an integrated multi-function multi-device wrist-worn housing, are the subjects of the present invention.

SUMMARY OF THE INVENTION

The present invention contemplates the housing of one or more writing, probing or pointing instruments within the enhanced case, band, bracelet or strap of a wristwatch or like device. Moreover, the extraction and/or the insertion of the co-housed instruments is electrically sensed and communicated to the wristwatch or like device. There it is used to initiate a count down timer which, after expiration of a preset time interval, will produce an alarm.

The housed instrument is commonly a pen, a pencil, a probe, a pointer, or, preferably, a combination probe and pen. It is housed within a bore of complimentary shape and size. The extraction and insertion of the instrument from the bore is sensed, preferably by a simple electrical switch, or by several such switches, that are also contained within the bore. An electrical signal produced by the switch(es), normally a momentary electrical signal, is used to initiate a countdown timer. The interval of the countdown timer is preferably variably preset, normally by push button switches associated with the watch or similar device containing the countdown timer. At the expiration of the preset interval an alarm, preferably an audible alarm, is produced.

One function served by such a composite device is that a wearer/user of the device will, after the passage of a predetermined time interval from withdrawing the instrument from its housed location, be alerted by an alarm to return the instrument to its housing, thereby aiding in preventing loss of the instrument. Another purpose served by such a composite device is that an alarm time interval may be set in advance, and the device may thereafter be triggered to produce an alarm after expiration of the preset interval simply by a fast, and convenient, withdrawal of the instrument from its housed location within the device.

In its basic embodiment as a device suitable to be worn upon the wrist, the present invention includes a housing having and defining two cavities. A first cavity houses the works of a watch, or watch-works. The other, second, cavity houses one or more writing, probing and/or pointing instruments.

The device typically further includes one or more electrical sensors that are mounted within the second cavity of the housing. The electrical sensor(s) detects whether the writing, probing and/or pointing instrument is present in the second cavity or not. Meanwhile, the watch-works housed within the first cavity is electrically connected to the electrical sensor(s), and is sensitive thereto to mark a time interval.

The device typically further includes an alarm, preferably an audible alarm. In this eventuality the watch-works housed within the first cavity is sensitive to the electrical sensor(s) to count down a predetermined time interval. After the expiration of this predetermined time interval the alarm is activated.

Still further in the basic embodiment of the present invention as a device suitable to be worn upon the wrist, the housed instrument combines the functions of both writing and probing, or pointing. One preferred instrument is in the form of an elongate body having a pen or a pencil at one end and a probe, or pointer, at the other end. The pen or pencil is use to mark or to write. The probe/pointer is suitable to point and/or to push—such as against push button electrical switches—but it does not have any capability to mark or write. In this manner both a (i) pointer and a (ii) pen or pencil may be located in a same cavity of a housing that also contains, in another cavity, a watch or like device.

In one, preferred, embodiment the second cavity is in the shape of a hollow bore. Either end of the bore is selectively capped, normally with a small cap screw. The instrument housed within the bore, normally a pen or pencil combined with a probe or pointer, may be selectively manually inserted within, and extracted from, the other end of the bore, normally by screwing or unscrewing. In this manner the direction in which the instrument is extracted may be tailored to the preference of the user/wearer.

These and other aspects and attributes of the present invention will become increasingly clear upon reference to the following drawings and accompanying specification.

DESCRIPTION OF THE PREFERRED EMBODIMENT

Figure 1:
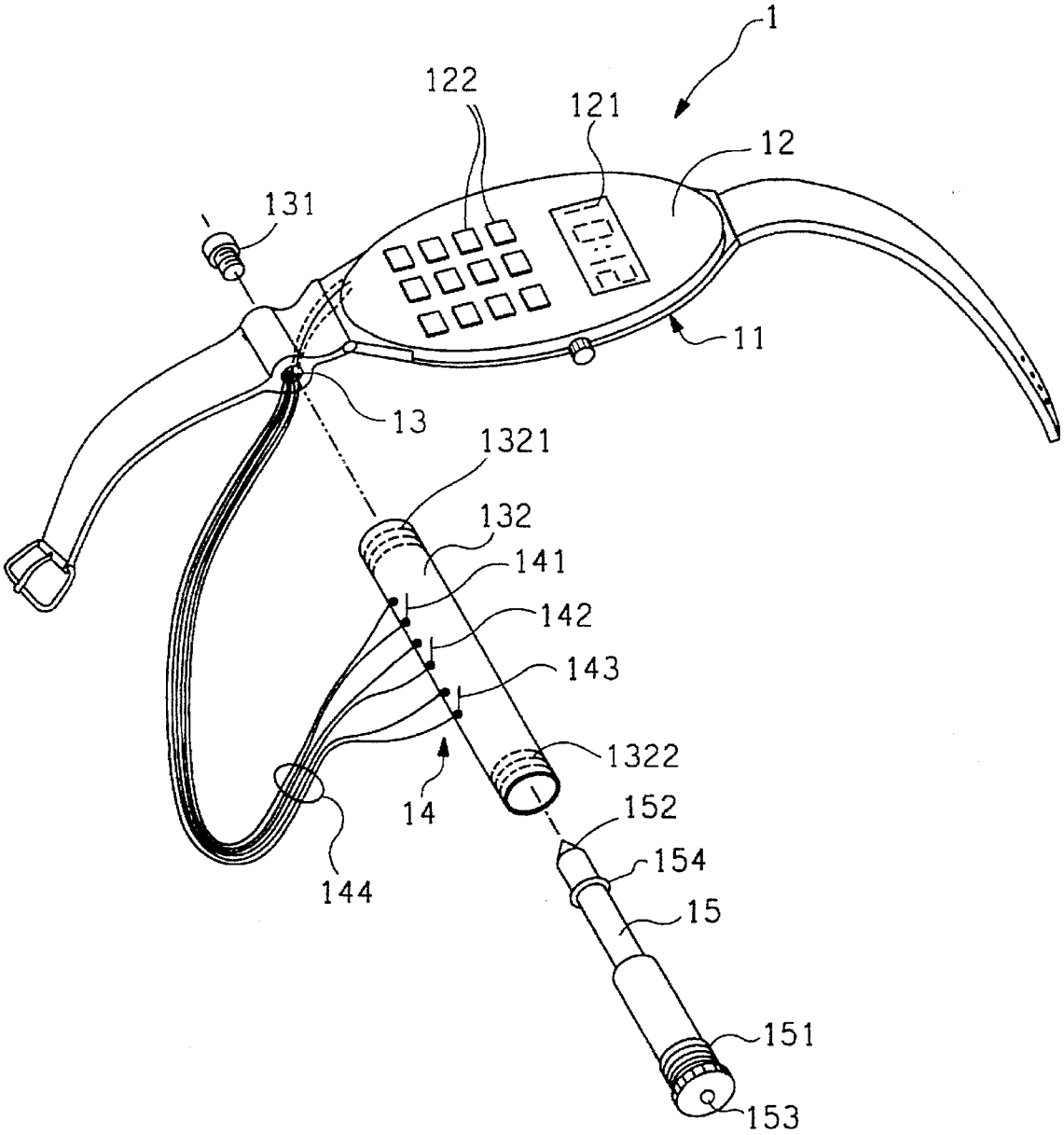
FIG. 1 is a diagrammatic perspective exploded view showing a preferred embodiment of a case, strap, bracelet or like wrist-mounted device containing in combination both (i) a watch works—commonly a multi-function electronic watch—and (ii) a housed marking, probing, or pointing instrument—commonly a pen—in accordance with the present invention.

A diagrammatic perspective exploded view showing a preferred embodiment of a case, or bracelet, or strap 1 in accordance with the present invention is shown in FIG. 1. The case, or bracelet, or strap 1 is intended to be worn upon the human wrist (not shown).

The case, or bracelet, or strap 1 can be varied in shape and in type, but always possesses at least two cavities. A first cavity 11 is shown to be filled in FIG. 1 with the works 12 of a watch or like device. The items housed in the first cavity may include, among many possibilities, watches, electronic calculators, cellular telephones, and radios. All of the items housed in the first cavity have a timekeeping function—although time of day or elapsed time or remaining time may not be normally be continuously presented, nor even presentable, to an optional display area 121.

The item or items housed in the first cavity typically include, in a region disposed to the top of the device, a number of switches 122, preferably of the push button type, that are typically located in an array. In accordance with the function—to be explained—of the case, or bracelet, or strap 1 to also house an instrument that preferably embodies a probe which may be held by the fingers to selectively activate the switches 122, the switches 122 may be, and commonly are, too small and/or too close together for convenient activation by the tips of human fingers (not shown).

The case, or bracelet, or strap 1 further has and defines a second cavity 13, which cavity 13 is shown empty in FIG. 1. Although the case, or bracelet, or strap 1 is particularly illustrated in FIG. 1 in a configuration of (i) a conventional watch case connecting (ii) a nearly conventional strap save for the added presence of the cavity 13, it is clear that the cavity 13 need not be in a position normally associated with a strap of a common wristwatch. The cavity 13 can alternatively be variously located in structures, and in portions of structures, that are commonly called cases, or bands, or bracelets. For example, the entire assembly 1 could be more substantially in the form of a monolithic bracelet, with the second cavity 13 located anywhere along its circumference. For example, the second cavity 13 could in particular be located more closely adjacent to, or abutting, the first cavity 11, and might thus appear to be in a position normally associated with the case of a common wristwatch. In such a case either, or both, ends of an instrument 14 (to be discussed) that is fitted within the cavity 13 could have the substantial visual appearance of such knobs and switches as are commonly associated with the periphery of a common wristwatch.

It will therefore be recognized that, in its broadest aspect, the present invention resides in (i) the function of the case, or bracelet, or strap 1 to provide two cavities 11, 13 each of which houses a respective item(s), and to provide (in a manner to be discussed) an electrical interconnection between the two cavities (to be discussed), and (iii) in the cooperative interaction between a watch works 12 that is housed in a first cavity 11, and an instrument 14 (to be discussed) that is housed in a second cavity 13, and not in any particular location, or size, or configuration, of either, and of both, of the two cavities 11, 13. In terms of the precise sizes and locations of the cavities 11, 13 illustrated, FIG. 1 will thus be understood to be exemplary, only, and not to be limiting of the scope of the present invention.

The cavity 13 is preferably in the shape of a bore, and is thus also a bore 13. A cap 131 is fitted to a one, selected, end of the bore 13, preferably by screwing. The bore 13 preferably contains an internal sleeve, or bore liner, 131, primarily for ease of construction and repair. In the exploded view of FIG. 1 this internal sleeve 131 is shown extracted from the bore 13, as indicated, for improved visibility of components internal within the bore. During use of the device 1, the internal sleeve 131 is permanently retained within the bore 13. The internal sleeve 132 preferably has threads 1321, 1322 at each end to facilitate its threaded engagement with, respectively, a cap 131 in the form of a cap screw, and the threads 151 of a housed instrument 15 (to be discussed).

One or more sensor switches 14, and preferably three such sensor switches 141, 142 and 143, are mounted at the interior of bore 14, normally by affixation to the sleeve 132 which is, a aforesaid, permanently retained within the bore 13 during use of device 1. These sensor switches 141–143 are normally simple contact pressure switch. Each of the switches 141–143 is preferably mounted on the cylindrical internal sleeve 132, which may be inserted and extracted from the bore 13 for purposes of access to and repair of any of the switches 141–143.

The switches 141–143 are each electrically connected by wires 144 to the electronic timekeeping circuitry of the watch works 12 that are housed within the cavity 11. This electrical connection is only diagrammatically shown in FIG. 1, and the precise electrical connection of the switches 141–143 to the timekeeping circuitry of the watch works 12 is shown in electrical and mechanical schematic diagram only in FIG. 2.

An instrument 15 is selectively inserted within, and extracted from, the internal sleeve 132 which is itself within the second cavity 13 of the case, or bracelet, or strap 1. This insertion or extraction is preferably by process of screwing over the length of a few turns of screw threads 151 coupled with a pulling or a pushing motion, as the case may be. As illustrated in FIG. 1, the instrument 15 is of an obviously complimentary shape and size to the internal liner 132, and to the cavity 13, into which it snugly fits.

The instrument 15 may embody any of the functions of writing, probing, pointing or like functions as are commonly realizable in an elongate cylindrical body. The preferred embodiment of the instrument 15 has a pen 152 at its end that is normally concealed and protected within the cavity 13, and a probe 153 suitable to activate the push button switches 122 at its other, remaining, end. The two ends of the instrument 15 are more preferably telescoping one relative to the other, and the point of the pen 152 may optionally retract in the manner, and by the standard mechanism, of a common retractable ball point pen. Finally, the instrument 15 has a circumferential ring, or ridge, 154 that is suitable to activate the switches 141–143 in a manner to be explained. This circumferential ring, or ridge, 154 also serves to better maintain the instrument 15 in a stable, shock-resistant, position when it is inserted within the cavity 13.

The instrument 15 fits sufficiently snugly in the liner 132 to the cavity 13 so as to activate each of the switches 141–143, normally so as to force each switch in succussion momentarily to an electrically closed condition, whenever the instrument 15 is positioned within the cavity 13. Conversely, when the instrument 15 is either withdrawn from, or completely inserted into, the liner 132, and in the cavity 13, then each of the switches 141–143, which switches are each spring loaded, assumes an electrically open condition.

Figure 2:
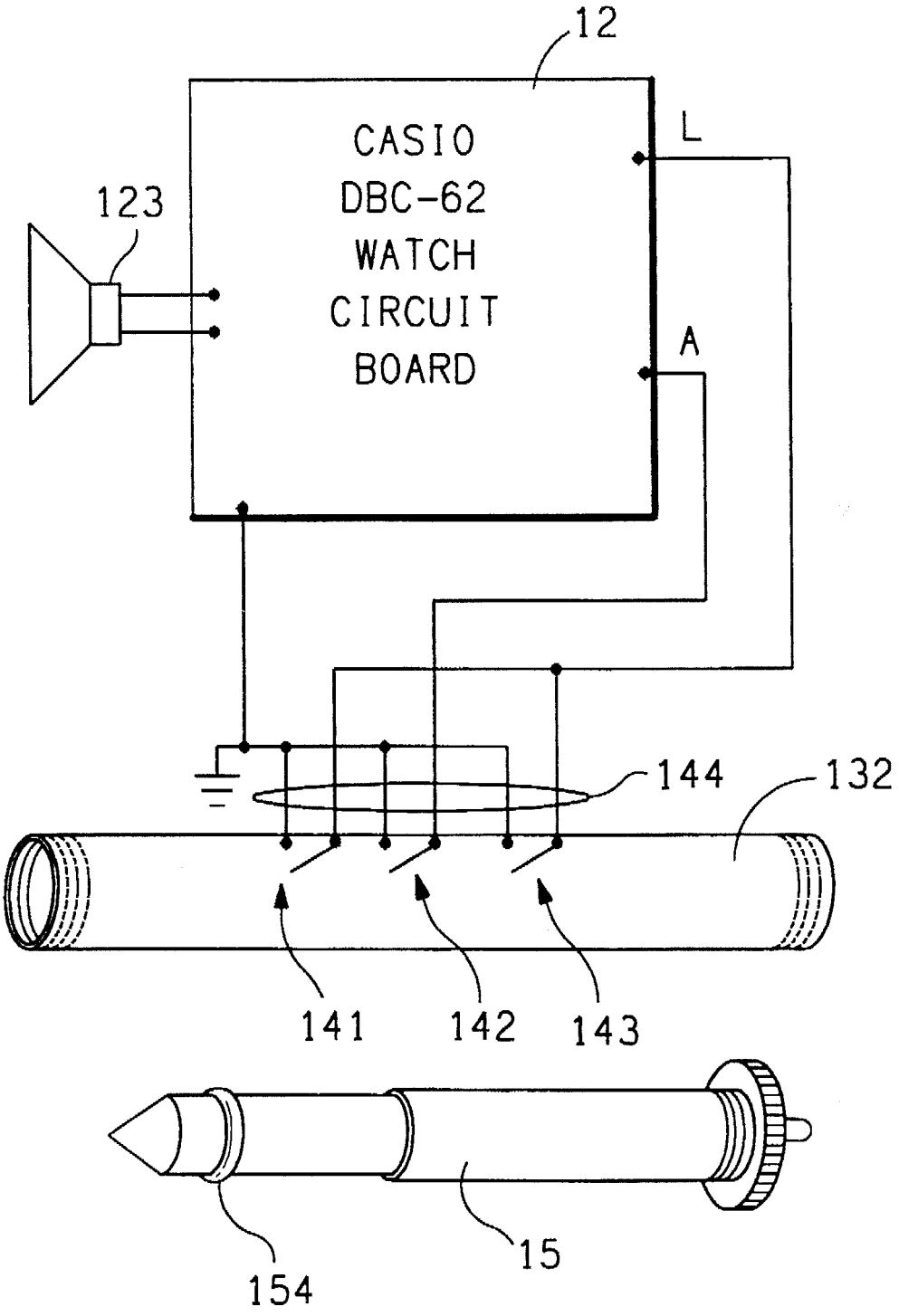
FIG. 2 is an electrical and mechanical schematic diagram of the preferred embodiment of the watch works integrally housed with a marking/probing/pointing instrument in accordance with the present invention, which combination device was previously seen in FIG. 1.

A combination electrical and mechanical schematic diagram of the preferred embodiment of the present invention, previously seen in FIG. 1, is shown in FIG. 2. The instrument 15 with its circumferential ring, or ridge, 154, and also the internal liner 132 (to the cavity 13, shown in FIG. 1) will be recognized from FIG. 1. The switches 141–143 that are physically mounted to the liner 132, and that are thus within the cavity 13 (shown in FIG. 1), are electrically connected to the watch works 12 by the cable 144 (previously seen in FIG. 1). The preferred watch works 12 is a CASIO® DBC-62 WATCH CIRCUIT BOARD available from Casio, Inc., 570 Mount Pleasant Avenue, Dover N.J., U.S.A. (CASIO is a registered trademark of Casio, Inc.). There is absolutely nothing unique, or special, about this particular watch works 12 for use in the composite device 1 of the present invention. It is merely illustrative of many modern multi-function electronic watches suitable for use in the present invention.

In particular, the preferred watch works 12, or the CASIO® DBC-62 WATCH CIRCUIT BOARD, has number of push button electrical switches of which two labeled "L" and "A" are pertinent to the present invention. The switch "A" is more completely, and commonly, labeled "Secret/C, 12–24 Hr." or some like, and similarly cryptic, notation on the wearer-visible face of the watch works 12. Likewise, the switch "L" is more completely, and commonly, labeled "Shift/Light" or some like notation on the face of the watch works 12. As a user/wearer of these modern digital electronic watches will know, circa 1995, the proper use of all push button switches to the watch works 12, including switches "A" and "L", is ultimately determined by the directions supplied with the watch.

In the case of the preferred CASIO® DBC-62 WATCH CIRCUIT BOARD, a "countdown time" may be set as follows. An operating countdown alarm can be set from 1 minute to 24 hours (display shows 0:00:00). The countdown time interval is measured to an accuracy of 1 second. The commencement of countdown operation is accomplished by pressing switch "A", and is confirmed by a signal. When the display 121 (shown in FIG. 1) reaches zero a beeper sounds for 10 seconds or until any button is pressed.

The setting of the countdown time interval commences with the pressing of switch "A," as is typical to set any new time or time interval. Each press of switch "L" selects either an auto-repeat or a repeat function of the watch works 12. A mark (I) on the display 121 (shown in FIG. 1) of the watch works 12 indicates on the setting of the auto-repeat function. Next, either switch "A" or switch "L" is depressed to shift a flashing digit(s). Those digit(s) presently to be changed will flash. The appropriate numeral is pressed on keypad 122 (shown in FIG. 1) to input the associated value into the presently-selected numerical field. Finally, another switch is pressed to indicate to the watch works 12 that the setting of the countdown time interval is complete. At the expiration of the preset "countdown time interval", an alarm 123 will be momentarily sounded.

During use of the preferred watch works 12 in the device 1, its switch "L" is electrically wired in parallel to ground through each, and both, parallel-connected switches 141 and 143. Similarly, the switch "A" is wired in parallel to ground through the single switch 142.

During use of the device 1, the watch works 12 are present to a countdown interval by use of watch works 12 switches "A" and "L". During this operation, the switches 141–143 are not involved, and are of no effect.

Consider that the instrument 15 is initially sheathed and housed within the liner 132 in the orientation shown. Upon withdrawal from left to right (as illustrated in FIG. 2), the circumferential ring, or ridge, 154, will momentarily successively activate, in order, each of switches 141, 142 and 143. The momentary activation of switch 141 is without effect. The momentary activation of switch 142 will cause the countdown timer within the watch works 12 to start to decrement the preset countdown time interval. The momentary activation of switch 141 is without effect. Notably, the exact same effect is achieved should the instrument 15 be housed, and withdrawn from the opposite direction, i.e., from right to left. In such a case the successive activation of, in order, switches 143, 142 and 141 would produce exactly the same effect, namely that the watch works 12 is enabled and started to count down the preset countdown time interval.

The successive momentary activation of switches 141–143, or, equivalently, switches 143–141, is occasioned upon the withdrawal of the instrument 15 from the cavity 13. If it is not returned to such cavity 13 within the preset countdown time interval, the alarm 123 will be sounded by the watch works 12. This serves to alert the user/wearer who has extracted the instrument 15 to the passage of time and/or that the instrument has not been timely returned to its housed position in the cavity 13.

Consider the return of the instrument 15 to its sheathed and housed within the liner 132, and the cavity 13, in that orientation shown in FIG. 2. Upon insertion from right to left (as illustrated in FIG. 2), the circumferential ring, or ridge, 154, will momentarily successively activate, in order, each of switches 143, 142 and 141. The momentary activation of switch 143 is without effect. The momentary activation of switch 142 will cause the countdown timer within the watch works 12 to stop any decrement of the preset countdown time interval. The momentary activation of switch 143 will now, as an activation equivalent to a second activation of watch works 12 switch "L", cause the countdown timer to reset. Notably, the exact same effect is again achieved when the instrument 15—housed in the liner 132 in the opposite direction to that illustrated in FIG. 2—is again returned to its sheathed and housed position, this time from left to right. In such a case the successive activation of, in order, switches 141, 142 and 143 will produce exactly the same effect, namely that the countdown timer of the watch works 12 is stopped and reset.

In accordance with the preceding explanation, variations and adaptations of the enhanced case, or band, or bracelet integrally housing both a wristwatch and a pen/pointer/probe in accordance with the present invention will suggest themselves to a practitioner of the mechanical and electrical design arts.

For example, plural instruments may be nested one within the next so as to all be housed within the one, substantially cylindrical, bore comprising the second cavity of the enhanced case of a wristwatch or like device. A first elongate hollow tubular instrument, commonly a pointer or scribe, may be selectively manually inserted within and extracted from the case's bore. Yet another, second, elongate tubular instrument, commonly a pen or pencil, may selectively manually inserted within and extracted from the hollow interior of the first tubular instrument. The function served by such nested devices is that two separate and different instruments, commonly a (i) probe and a (ii) pen, may be selectively individually withdrawn from the same housing depending upon, for example, whether it is desired to push the push button keys on a keypad with the probe, or to write on a surface.

For example, other watch types having slightly different electrical and/or mechanical switch controls may be adapted to the purposes of the present invention.

In accordance with these and other possible variations and adaptations of the present invention, the scope of the invention should be determined in accordance with the following claims, only, and not solely in accordance with that particular embodiment within which the invention has been taught.

What is claimed is:

1. A device suitable to be worn upon the wrist of a user comprising:

a housing having and defining two cavities a first one of which cavities is suitable to house works of a watch and the other, second, one of which cavities is suitable to house an elongate instrument suitable for one or more of writing, probing or pointing;

a watch works for timekeeping housed within the first cavity of the housing, the watch works including a time interval counter responsive to an electrical signal for marking a time interval;

an elongate instrument removably housed within the second cavity of the housing, the elongate instrument capable of being selectively withdrawn from and inserted into the second cavity by action of the user's fingers;

a sensor, housed within the second cavity of the housing, for producing an electrical signal in response to sensing whether the instrument is present in the second cavity or not; and a wire for electrically connecting the electrical signal produced by the sensor to the watch works;

wherein the time interval counter is responsive to the sensor to mark a time interval.

2. The device according to claim 1 wherein the time interval counter of the watch works comprises:

a count down timer for counting down a predetermined time interval; and an alarm responsive to the count down timer for producing an alarm after an expiration of the predetermined time interval;

wherein the count down timer of the watch works is sensitive to the sensor to mark a predetermined time interval, after the expiration of which predetermined time interval the alarm is produced.

3. The device according to claim 1, wherein the watch works for timekeeping comprises:

means exercisable by the user for predetermining the time interval.

4. The device according to claim 3, wherein the means exercisable by the user for predetermining the time interval comprise:

push button switches located on a surface of the watch works and suitably sized and contoured so as to be activated by the elongate instrument as extracted by the user from the second cavity, and in performance of the probing function.

5. A device suitable to be worn upon the wrist of a user comprising:

a housing having and defining at least two cavities a first one of which cavities is suitable to house a watch and another, second, elongate one of which cavities is suitable to house a pen;

a watch housed within the first cavity of the housing, the watch including a count down timer responsive to an electrical signal for marking a time interval;

an alarm responsive to the count down timer for producing an alarm after an expiration of a predetermined time interval;

a pen housed within the elongate second cavity of the housing, the pen being capable of being selectively withdrawn from and inserted into the second cavity by action of the user's fingers;

a sensor, housed within the elongate second cavity of the housing, for producing an electrical signal in response to sensing whether the pen is present in the elongate second cavity or not;

a wire for electrically connecting the electrical signal produced by the sensor to the count down timer of the watch;

wherein the count down timer is responsive to the sensor, which is itself responsive to the presence of the pen within the elongate second cavity, to mark a time interval, after the expiration of which time interval an alarm will be produced.

6. A device suitable to be worn upon the wrist of a user comprising:

a housing having and defining two cavities a first one of which cavities is suitable to house works of a watch and the other, second, one of which cavities is suitable to house an elongate instrument suitable for one or more of writing, probing or pointing;

a watch works for timekeeping housed within the first cavity of the housing, the watch works including a time interval counter responsive to an electrical signal for marking a time interval;

a pen removably housed within the second cavity of the housing, the pen capable of being selectively withdrawn from and inserted into the second cavity by action of the user's fingers;

a sensor, housed within the second cavity of the housing, for producing an electrical signal in response to sensing whether the pen is present in the second cavity or not; and a wire for electrically connecting the electrical signal produced by the sensor to the watch works;

wherein the time interval counter is responsive to the sensor to mark a time interval.

7. The device according to claim 6 wherein the pen comprises:

an elongate telescoping body;

a marker at one end of the elongate body; and a probe suitable to push against push button switches at the other end of the elongate body.

8. A device suitable to be worn upon the wrist of a user comprising:

a housing having and defining two cavities a first one of which cavities is suitable to house works of a watch and the other, second, one of which cavities is a bore, open and threaded at both ends, suitable to house an elongate instrument suitable for one or more of writing, probing or pointing;

a watch works for timekeeping housed within the first cavity of the housing, the watch works including a time interval counter responsive to an electrical signal for marking a time interval;

an elongate instrument removably housed within the second cavity of the housing, the elongate instrument capable of being selectively withdrawn from and inserted into the second cavity by action of the user's fingers, the elongate instrument comprising a cap screw capable of being screwed under force of the user's fingers to seal shut a selected one end of the bore, and a telescoping elongate body that is capable of being collapsed in length and then screwed under force of the user's fingers within the remaining end of the bore so as to be removably housed therein;

a sensor, housed within the second cavity of the housing, for producing an electrical signal in response to sensing whether the instrument is present in the second cavity or not; and a wire for electrically connecting the electrical signal produced by the sensor to the watch works;

wherein the time interval counter is responsive to the sensor to mark a time interval.

9. A device suitable to be worn upon the wrist of a user comprising:

a housing having and defining two cavities a first one of which cavities is suitable to house works of a watch and the other, second, one of which cavities is elongate;

a watch works for timekeeping housed within the first cavity of the housing including a time interval counter responsive to an electrical signal for marking a time interval;

a collapsible elongate instrument telescoping in length and removably housed within the second cavity of the housing, the elongate instrument capable of being selectively collapsed to a shorter length so as to be inserted in the second cavity and thereafter withdrawn from the second cavity and telescoped to a greater length so as to thereafter be manipulated by the user's fingers;

a band enraging the housing so as to hold it upon the user's wrist regardless of whether either or both the watch works and the collapsible elongate instrument are or are not within their respective cavities;

a sensor, housed within the second cavity of the housing, for producing an electrical signal in response to sensing whether the instrument is present in the second cavity or not; and a wire for electrically connecting the electrical signal produced by the sensor to the watch works;

wherein the time interval counter is responsive to the sensor to mark a time interval.

* * * * *